United States Patent [19]

Ronan

[11] 4,383,709

[45] May 17, 1983

[54] ANTI-SHIM SAFETY DEVICE FOR PREVENTING WRONGFUL DISENGAGEMENT OF DOOR LATCHES

[75] Inventor: Thomas O. Ronan, Memphis, Tenn.

[73] Assignee: Holiday Inns, Inc., Memphis, Tenn.

[21] Appl. No.: 161,211

[22] Filed: Jun. 19, 1980

[51] Int. Cl.[3] ..... E05C 21/00

[52] U.S. Cl. ..... 292/346; 292/340

[58] Field of Search ..... 292/346, 216, 357, 340

[56] References Cited

U.S. PATENT DOCUMENTS

| | | | |
|---|---|---|---|
| 1,021,672 | 3/1912 | Hart | 292/357 X |
| 1,670,442 | 5/1928 | Fetter | 292/251 X |
| 2,144,075 | 1/1939 | Mora | 292/346 |
| 2,665,156 | 1/1954 | Allen | 292/216 |
| 3,279,840 | 10/1966 | Barone | 292/346 |
| 3,392,999 | 7/1968 | Thompson | 292/346 |
| 3,764,173 | 10/1973 | Griffith | 292/346 |
| 3,888,530 | 6/1975 | Fabrici | 292/346 |

FOREIGN PATENT DOCUMENTS

| | | | |
|---|---|---|---|
| 2755961 | 6/1979 | Fed. Rep. of Germany | 292/346 |

*Primary Examiner*—Richard E. Moore

[57] ABSTRACT

Improved safety device for installation on door jambs in hotels, motels and the like to prevent the use of shim-type devices for unauthorized entry into guest rooms, wherein the device comprises a right angled strip of metal, to be secured to the door jamb opposite the free end of the door when the door is in the closed position, the device having a portion adapted to lap against the outer side of the door, so as to provide maximum resistance to insertion of a shim or similar article between door and lapped portion, thus preventing penetration far enough to disengage the latch bolt from the striker plate aperture in which it is engaged in the normal, locked position.

4 Claims, 4 Drawing Figures

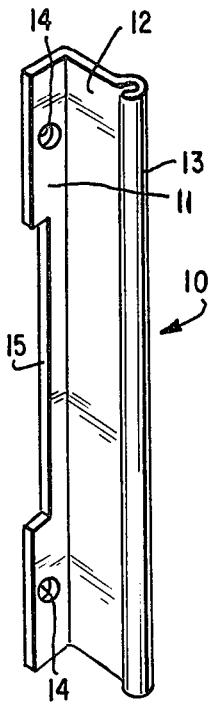
FIG. 1
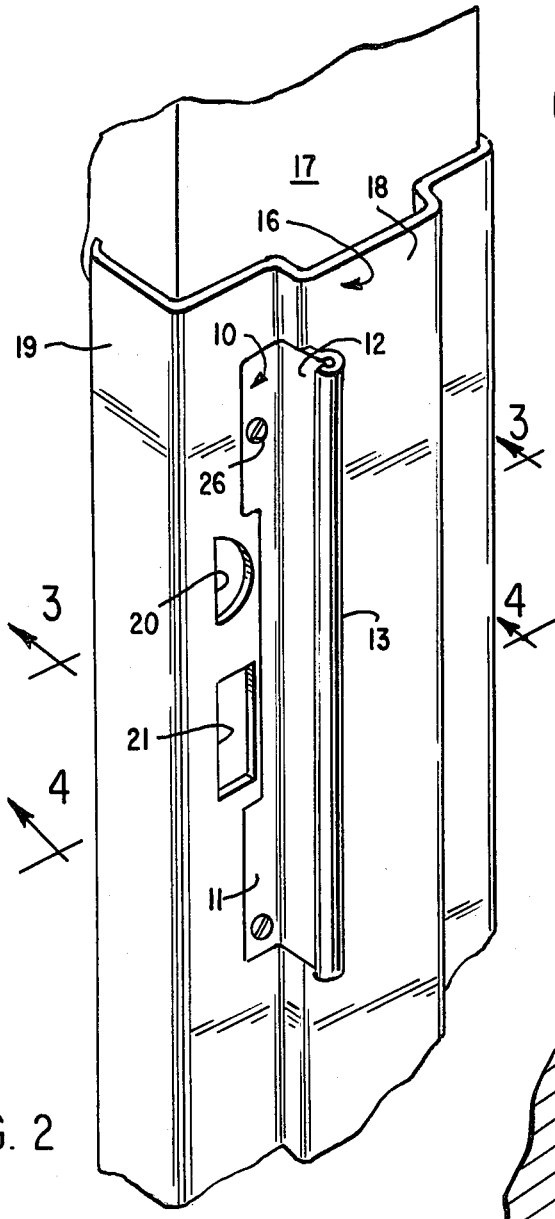
FIG. 2
FIG. 3
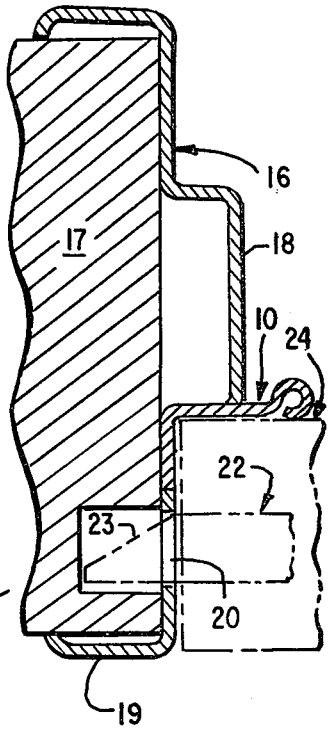
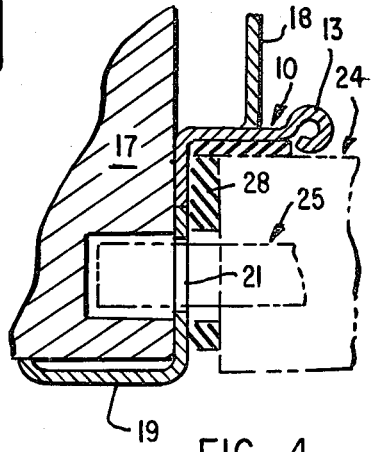
FIG. 4

ANTI-SHIM SAFETY DEVICE FOR PREVENTING WRONGFUL DISENGAGEMENT OF DOOR LATCHES

My invention relates to a safety device that is adapted to be installed on door jambs of guest room doors in hotels, motels and other establishments where it is desirable to insure that occupants will not be disturbed and their belongings will be secure against loss by reason of surreptitious entry by unauthorized persons.

BACKGROUND OF THE INVENTION

Hotels, motels and other transient residential establishments are constantly confronted with the problem of assuring that their guests are secure in their rooms and that no unauthorized persons will be able to gain access to such rooms when the guests are away. When guests are in their rooms, they are able to use the dead bolt locks or chains usually provided to prevent entry. It would be unduly burdensome for all concerned, however, to require guests to use double keys or submit to tedious identification procedures as an expedient for thwarting would-be thieves or intruders when the guests are not in their rooms. Therefore, continuing efforts have been made to find ways and means of preventing guest room doors from being opened, other than with keys intended for that purpose.

Almost invariably, doors to guest rooms open inwardly. Such doors are provided with spring-loaded latches which engage in suitably aligned apertures in cooperating striker plates on the door jambs. The spring-loaded latch or bolt is provided on the side which first contacts the striker plate with an oblique or slanted face so that as the door is closed, the bolt is caused to retract by reason of the striker plate pressure on the slanted face until the bolt is in position opposite the cooperating aperture in the striker plate, when spring pressure causes the bolt to be thrust into the aperture. The opposite face of the bolt is not slanted, so that in order to operate the retraction mechanism, it is necessary to turn the doorknob engaged therewith to disengage the bolt from the aperture. Normally, the retraction mechanism can be operated only from inside the room without a key. From the outside, it is necessary to use a key to cause the bolt to retract from the striker plate.

The big problem with such locks has been the fact that there is usually enough space between the door and the striker plate, and the trim on the door jamb against which the door is engaged when it is closed, to enable a dextrous person to insert jimmying tools, shims or even flexible plastic credit cards in that space in such a manner as to exert pressure on the slanted face of the bolt and it to retract, thus becoming disengaged from the aperture in the striker plate and allowing the door to be opened.

Locksmiths and others have worked for many years on the problem of finding ways to prevent insertion of jimmying tools or shim-like objects into the space between the door and the striker plate. Some of the means thus devised have employed auxiliary metal strips, of varying cross-sectional shapes, for installation on the door jamb, adjacent the striker plate-sometimes with cooperating or interlocking strips on the door. Examples of such metal strips are found in patents issued to A. Barone, U.S. Pat. No. 3,279,840 granted Oct. 18, 1966, and to E. L. Thompson, U.S. Pat. No. 3,392,999, granted July 16, 1968. Examples of those in which cooperating door strips are used are patents issued to F. M. Sushan, U.S. Pat. No. 3,405,962, granted Oct. 15, 1968, and to Grinbaum, et al., U.S. Pat. No. 3,895,834, granted July 22, 1975.

Previous devices for making doors jimmy-proof have had varying degrees of effectiveness, which was often inversely proportional to their complexity. Therefore, a need has continued to exist for a device to safeguard guest room doors against jimmying and which could combine maximum simplicity with maximum effectiveness.

SUMMARY OF THE INVENTION

It is a principal object of my invention to provide a safety device for attachment to the door jambs of hotel and motel guest rooms which is simple, low cost, readily installable on existing jambs, and offers maximum resistance to insertion of shims, jimmying tools, plastic cards, or other instrumentalities from outside the room to force retraction of a latch bolt from its locked position in a striker plate. It is a further object of my invention to provide such a device which is aesthetically suitable for use in luxury-type establishments, which is relatively inconspicuous, and which can serve other useful purposes, such as resisting rattling due to variations in air pressure between room and corridors, such as is sometimes caused by opening room windows or balcony doors.

To accomplish these objects, I have designed a one-piece, right, angled strip of metal, with an open-ended, longitudinal curl along one edge. The portion of the strip without the curl is provided with spaced screw holes to enable attachment to a door jamb in conjunction with a striker plates opposite the portion of the door in which the latch bolt is installed, in a manner to lap against the outer side of the door straddling the area where jimmying instruments would have to be inserted to disengage the bolt. The longitudinal curl minimizes the space within which a shim could be inserted, and further provides a pleasing appearance.

In instances where the door is somewhat ill-fitting with respect to the jam or loosely hung, a pad of adhesive foam or similar resilient material can be secured to the lapped portion of the strip in such a manner that the resilient material is compressed between the metal strip and the edge of the door. The pad extends the length of the metal strip, and firmly resists insertion of a tool or instrument therebetween. The mass of the door is such that it can exert much greater pressure against a relatively short pad of resilient material than against weatherstripping, for example, that extends the full height of the door. A second pad of adhesive foam or resilient material on the portion of the metal strip can also be secured to the door jamb and on adjacent portions of the striker plate, other than the bolt aperture, to provide additional resistance to insertion of any tool or instrument between the door and jamb in a manner to disengage the latch bolt in the case of ill-fitting doors.

BRIEF DESCRIPTION OF THE DRAWING

FIG. 1 is a perspective view of the anti-shim device of my invention;

FIG. 2 is a view of said anti-shim device mounted on a typical hotel or motel door jamb;

FIG. 3 is a sectional view taken, as indicated, along the line 3—3 of FIG. 2; and FIG. 4 is a fragmented sectional view taken, as indicated, along the line 4—4 of FIG. 2.

Referring to the drawing, the anti-shim device embodying my invention is indicated generally by the numeral 10 and, as shown in FIG. 1, comprises a mounting portion 11 for attachment to a door jamb, a lapping portion 12 that extends outwardly from the door jamb and terminating in a longitudinal curl 13. Screw holes 14 are provided for securing the mounting portion 11 to the door jamb, and an offset or notched portion 15 is provided to allow space in the door jamb or striker plate for bolt apertures.

Preferably, the strip 10 is made of steel, about 1/32 inch in thickness, and is about eight inches in length, although these dimensions can be varied as desired to adapt the device to different installations. In my preferred embodiment, the mounting portion 11 is approximately one-half inch wide, and the lapping portion 12, not including the integral curl 13, is about 9/16 inch, the curl being about ¼ inch in diameter, with the free end tucked inwardly somewhat. The notch portion 15 is about four inches in length and ¼ inch wide.

As shown in FIG. 2, door jambs 16 of the type used in modern hotels and motels are usually steel stampings to fit over the wall ends 17 that form the door opening. The jamb 16 has a raised or humped center portion 18 extending lengthwise of the jamb to form a door stop or stop rail, such as the wooden molding strips used for that purpose in conventional housing construction. Along its respective sides, the jamb 16 has lengthwise flanges 19 which engage the corresponding sides of the wall 17.

In metal door jambs of the type illustrated in the drawing, the striker plate is generally integral with the jamb 16, whereas in conventional housing construction, the striker plate is a separate metal plate secured to the door jamb, made of lumber. The anti-shim device 10 embodying my invention is, of course, readily applicable to wooden door jambs, as will be understood, but is illustrated here with metal door jambs of the type with which it is most likely to be used commercially.

The striker plate portion of the door jamb 16 is provided with an upper bolt aperture 20 and a lower bolt aperture 21, the upper aperture being adapted to serve as a receptacle for a conventional, spring-loaded latch bolt 22, as indicated by the broken lines in FIG. 3. The leading edge of the latch bolt 22 is slanted to form an oblique face 23, so that when the door 24 (indicated by dotted lines) is being closed, the oblique face 23 is the first portion of the bolt 22 to make contact with the striker plate portion of the door jamb 16, and the pressure exerted thereby against the face 23 causes the bolt to retract against spring pressure until it slides far enough to reach the aperture 20 where, by reason of spring loading, it is propelled into the aperture. It is this bolt which my anti-shim device is designed particularly to protect against jimmying.

Most guest room doors also have a dead bolt 25, operable only from inside the room, so that guests can have double lock portection against being disturbed while they are in their rooms. The dead bolt 25 is engageable in the lower bolt aperture 21, and both bolts are within the zone of protection provided by my invention.

In the embodiment shown in the accompanying drawing, the metal door jamb 16, is formed specifically to receive the anti-shim device 10, and so it is provided with a cut-out area, the shape of the mounting portion 11 of the device 10. Where such a cut-out portion is provided, the mounting portion 11 may be secured directly to the wall 17 by means of screws inserted through the holes 14, such as the screw 26 of FIG. 2. Likewise, the door frame or jamb 16 can be stamped to provide a seat corresponding to the shape of the mounting portion 11. Additionally, as shown in the drawing, the door stop 18 can be notched or stamped the depth of the metal gauge of the device 10 and of the length thereof so as to provide a recess in which the innermost section of the lapping portion 12 can be seated. When so installed, the surface of the lapping portion 12 facing the door can be flush with the door-engaging edge of the door stop 18.

Although not normally required, in the case of the lose or ill-fitting doors, the side of the lapping portion 12 against which the door is to be closed can be provided with a guard layer 27 of adhesive foam of any readily available commercial type as shown in FIG 3. The guard layer 27 is compressible and is preferably of sufficient thickness to insure that in any installation, it will be subject to some compression when the door is closed with the latch bolt 22 engaged in the aperture 20. Any other suitable resilient material may, of course, be used to form the guard layer 27. The guard layer should be of approximately the same length as the lapping portion 12 and about the same width as the flat or planar portion thereof.

Also, in instances involving ill-fitting doors, a second guard strip 28 of similar resilient material may be secured to the striker plate surface of the door jamb 16, with portions removed on the room interior side of the upper aperture 20 so as not to interfere with operation of latch bolt 22. As noted, the second guard strip 28 is particularly useful when my invention is used in older installations, where the doors may tend to be somewhat ill-fitting or loose. The second guard strip 28 should be of about the same thickness as the gap between door 24 and jamb 26 so as to permit a snug engagement with the door, without interfering with its being closed.

As will be readily understood by persons familiar with jimmying techniques, a shim or jimmying tool needs a defined path through which it can be inserted. The path can be very thin and even tortuous, but a sufficiently flexible instrument can follow such a path to the latch bolt the instrument is calculated to disengage. There is no such path available between the door and the frame because of the design of the curl of my invention. When the door is closed, the curl is virtually certain to resist, deflect or damage any shim-like article which a would-be intruder would endeavor to insert between the latched door and guard layer. If the second guard strip is used, that simply provides additional resistance to insertion or manipulation of a jimmying tool.

The anti-shim device of my invention has been shown and described in a preferred form, with the suggestion that various modifications are contemplated, it being understood that the scope of my invention is to be determined by the appended claims.

I Claim:

1. In combination with structure defining a jamb and stop rail for a door, guard means to prevent insertion of shim-like articles between the jamb, rail and door, said guard device comprising an elongated strip of relatively rigid material having a substantially planar, longitudinal face interposed between first and second longitudinal margins, one of said margins having integral means for firm attachment to said jamb, the other of said margins having an integral longitudinal extension with a free edge extending lengthwise thereof, said extension being contoured to form a bulge-like border with said free edge being generally in-turned, said a first layer of foam-like resilient material affixed to said face to be compressed when said device is mounted on said jamb and the door is closed, and a second layer of foam-like resilient material affixed to the jamb in juxtaposition with said first layer.

2. The combination of claim 1 wherein said first layer comprises an adhesive foam.

3. In combination with structure defining a door jamb and stop rail for receiving a door wherein said jamb has a door end confronting face and said rail has a door side confronting face, anti-shim means for preventing insertion of shim-like articles between said door, jamb and rail, said anti-shim means comprising:

an elongated strip of relatively rigid material that includes a smooth planar face portion and a longitudinal bulge-like portion forming a longitudinal border thereof, said strip being rigidly connected to said structure with said face portion extending in perpendicular relation to said end confronting face beyond said rail and in confronting relation to said door side, said bulge-like portion being integral of said planar face portion and having a surface region disposed slightly out of the plane of said planar face portion to be engageable with said door side prior to any engagement between said door side and said planar face portion.

4. The combination of claim 3 wherein said jamb and rail include recessed regions for receiving said strip .

* * * * *